US009914201B2

(12) United States Patent
Chu

(10) Patent No.: US 9,914,201 B2
(45) Date of Patent: Mar. 13, 2018

(54) RATCHET TOOL DEVICE

(71) Applicant: Te Chen Chu, Taichung (TW)

(72) Inventor: Te Chen Chu, Taichung (TW)

( * ) Notice: Subject to any disclaimer, the term of this patent is extended or adjusted under 35 U.S.C. 154(b) by 298 days.

(21) Appl. No.: 14/723,534

(22) Filed: May 28, 2015

(65) Prior Publication Data

US 2016/0346907 A1 Dec. 1, 2016

(51) Int. Cl.
*B25B 13/46* (2006.01)
*B25B 15/04* (2006.01)

(52) U.S. Cl.
CPC ..... *B25B 15/04* (2013.01); *B25B 13/465* (2013.01); *B25B 13/468* (2013.01)

(58) Field of Classification Search
CPC ..... B25B 13/465; B25B 13/468; B25B 15/04; F16B 21/18; F16B 21/183; F16B 21/186
USPC ..... 81/62, 63.1, 58.4
See application file for complete search history.

(56) References Cited

U.S. PATENT DOCUMENTS

| | | | | |
|---|---|---|---|---|
| 5,613,585 | A | 3/1997 | Tiede | |
| 5,642,794 | A | 7/1997 | Chuang et al. | |
| 5,685,204 | A | 11/1997 | Braun | |
| 5,711,193 | A | 1/1998 | Eggert et al. | |
| 5,910,196 | A | 6/1999 | Huang | |
| 5,974,915 | A | 11/1999 | Chou | |
| 6,047,617 | A | 4/2000 | Chen | |
| 6,059,083 | A | 5/2000 | Tseng | |
| 6,070,503 | A | 6/2000 | Shiao | |
| 6,082,226 | A | 7/2000 | Lin | |
| 6,148,696 | A | 11/2000 | Chiang | |
| 6,349,619 | B1 * | 2/2002 | Liao | B25B 15/04 81/177.9 |
| 6,450,067 | B1 * | 9/2002 | Liao | B25B 13/465 81/62 |
| 6,644,147 | B1 * | 11/2003 | Huang | B25B 13/463 192/43.2 |
| 7,237,459 | B1 * | 7/2007 | Shiao | B25B 13/465 81/62 |
| 7,677,137 | B1 * | 3/2010 | Chen | B25B 13/465 81/62 |
| 8,522,651 | B2 * | 9/2013 | Xu | B25B 13/463 81/60 |

(Continued)

FOREIGN PATENT DOCUMENTS

| | | | | |
|---|---|---|---|---|
| DE | 2113917 A1 * | 10/1971 | | F16B 21/186 |
| DE | 102012213225 A1 * | 2/2014 | | F16K 31/06 |
| GB | 867381 A * | 5/1961 | | A01K 87/06 |

*Primary Examiner* — Joseph J Hail
*Assistant Examiner* — J Stephen Taylor
(74) *Attorney, Agent, or Firm* — Charles E. Baxley

(57) ABSTRACT

A ratchet tool device includes a shaft having two compartments formed by curved surfaces, two pawls pivotally attached to the shafts and each having a toothed segment and a swelling, a barrel having an opening for engaging with the shaft and having an internal gear for engaging with the toothed segments of the pawls and for determining the rotational direction of the barrel by the shaft, a spring biasing member is engaged between the pawls for biasing the toothed segments of the pawls to engage with the internal gear of the barrel, a control ferrule is engaged with the shaft and the barrel and includes two actuators for engaging with the swellings and for disengaging the toothed segments of the pawls from the internal gear of the barrel.

9 Claims, 5 Drawing Sheets

(56) References Cited

U.S. PATENT DOCUMENTS

| | | | | |
|---|---|---|---|---|
| 8,960,058 | B2 * | 2/2015 | Lai | B25B 23/1427 81/467 |
| 2005/0204868 | A1 * | 9/2005 | Liu | B25B 13/465 81/58.4 |
| 2005/0204869 | A1 * | 9/2005 | Shu | B25B 13/465 81/58.4 |
| 2006/0048610 | A1 * | 3/2006 | Hu | B25B 15/04 81/60 |
| 2009/0199683 | A1 * | 8/2009 | Hu | B25B 13/465 81/63.1 |
| 2015/0251297 | A1 * | 9/2015 | Chang | B25B 13/44 81/128 |

* cited by examiner

RATCHET TOOL DEVICE

BACKGROUND OF THE INVENTION

1. Field of the Invention

The present invention relates to a ratchet tool device, and more particularly to a ratchet tool device for effectively driving tool members, fasteners, work pieces or other driven members.

2. Description of the Prior Art

Various kinds of typical ratchet tool devices have been developed and comprise a ratchet mechanism provided therein for rotating or driving fasteners or work pieces in an active direction and a reverse direction selectively.

For example, U.S. Pat. No. 5,613,585 to Tiede, U.S. Pat. No. 5,642,794 to Chuang et al., U.S. Pat. No. 5,685,204 to Braun, U.S. Pat. No. 5,711,193 to Eggert et al., U.S. Pat. No. 5,910,196 to Huang, U.S. Pat. No. 5,974,915 to Chou, U.S. Pat. No. 6,047,617 to Chen, U.S. Pat. No. 6,059,083 to Tseng, U.S. Pat. No. 6,070,503 to Shiao, U.S. Pat. No. 6,082,226 to Lin, U.S. Pat. No. 6,148,696 to Chiang, and U.S. Pat. No. 6,450,067 to Liao disclose several of the typical ratchet tool devices each also comprising a ratchet mechanism provided in an outer housing or receptacle for rotating or driving fasteners or work pieces in an active direction and a reverse direction selectively. Normally, the ratchet mechanisms will be and should be subjected with a great torque while working.

However, the ratchet mechanisms normally include a relatively weak structure or configuration that may not be subjected with a great torque while rotating or driving the fasteners or work pieces, such that the strength of the ratchet mechanisms is required to be improved and increased or facilitated.

The present invention has arisen to mitigate and/or obviate the afore-described disadvantages of the conventional ratchet tool devices.

SUMMARY OF THE INVENTION

The primary objective of the present invention is to provide a ratchet tool device for effectively driving tool members, fasteners, work pieces or other driven members.

In accordance with one aspect of the invention, there is provided a ratchet tool device comprising a shaft including two compartments formed therein and each defined by a curved surface, the shaft including two cavities formed therein and communicating with the compartments of the shaft respectively, a first pawl and a second pawl each including a pin extended therefrom and engaged with the cavities of the shaft respectively for pivotally or rotatably attaching or mounting the first and the second pawls to the shaft, the first and the second pawls each including a curved surface for engaging with the curved surface of the shaft respectively and for guiding the first and the second pawls to smoothly rotate relative to the shaft, the first and the second pawls each including a toothed segment provided thereon and each including a swelling extended therefrom and located beside the toothed segment respectively, a barrel including an opening formed therein for engaging with the shaft, and including an internal gear provided therein for engaging with the toothed segments of the first and the second pawls and for determining the rotational or driving direction of the barrel by the shaft, the barrel includes a shank extended therefrom, a spring biasing member is engaged between the first and the second pawls for biasing and forcing the toothed segments of the first and the second pawls to engage with the internal gear of the barrel, a control ferrule includes a chamber formed therein for engaging with the shaft and the barrel, and includes a first actuator and a second actuator extended into the chamber of the control ferrule for engaging with the swellings of the first and the second pawls respectively and for selectively disengaging the toothed segments of the first and the second pawls from the internal gear of the barrel, and the control ferrule includes a first depression and a second depression formed therein, and a spring biased projection is disposed or engaged in the shaft for selectively engaging with either the first or the second depression of the control ferrule and for anchoring and positioning the control ferrule to the shaft at selected positions.

The shaft includes a groove formed therein for engaging with the spring biased projection. The first and the second pawls each include a recess formed therein for engaging with the spring biasing member and for stably retaining the spring biasing member between the first and the second pawls. The shaft includes a pole for retaining the spring biasing member between the first and the second pawls.

The shaft includes a stem extended therefrom, and the control ferrule includes a peripheral flange extended radially and inwardly therefrom for forming an orifice therein and for engaging with the stem, the peripheral flange of the control ferrule is engaged with the shaft for anchoring the control ferrule to the shaft.

A handle may further be provided and attached to the stem, and the stem includes at least one projection extended from the stem for engaging with the handle and for allowing the handle and the stem to be rotated in concert with each other and for allowing the stem to be effectively rotated or driven by the handle.

The control ferrule includes a seat, and the first depression and the second depression are formed in the seat. The control ferrule includes a retaining member engaged with the control ferrule, and the retaining member includes two folded end members engaged with the barrel for rotatably securing the barrel to the control ferrule.

The shaft includes a curved channel formed therein for slidably receiving or engaging with the seat and for guiding and limiting the seat and the control ferrule to pivot or rotate relative to the shaft and the barrel. The shaft includes two end stops formed or defined in the curved channel for engaging with the seat and for limiting the seat to pivot or rotate relative to the shaft.

The control ferrule includes a peripheral recess formed therein for engaging with the retaining member, and includes two cavities formed therein and communicating with the peripheral recess of the control ferrule for engaging with the folded end members of the retaining member.

The barrel includes a peripheral slot formed in an outer peripheral portion of the barrel for slidably receiving and engaging with the folded end members of the retaining member and for stably and rotatably securing or coupling or anchoring the barrel to the control ferrule.

The control ferrule includes a collar engaged onto the control ferrule and engaged with the retaining member for retaining the folded end members of the retaining member in engagement with the peripheral slot of the barrel and for rotatably securing the barrel to the control ferrule and the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
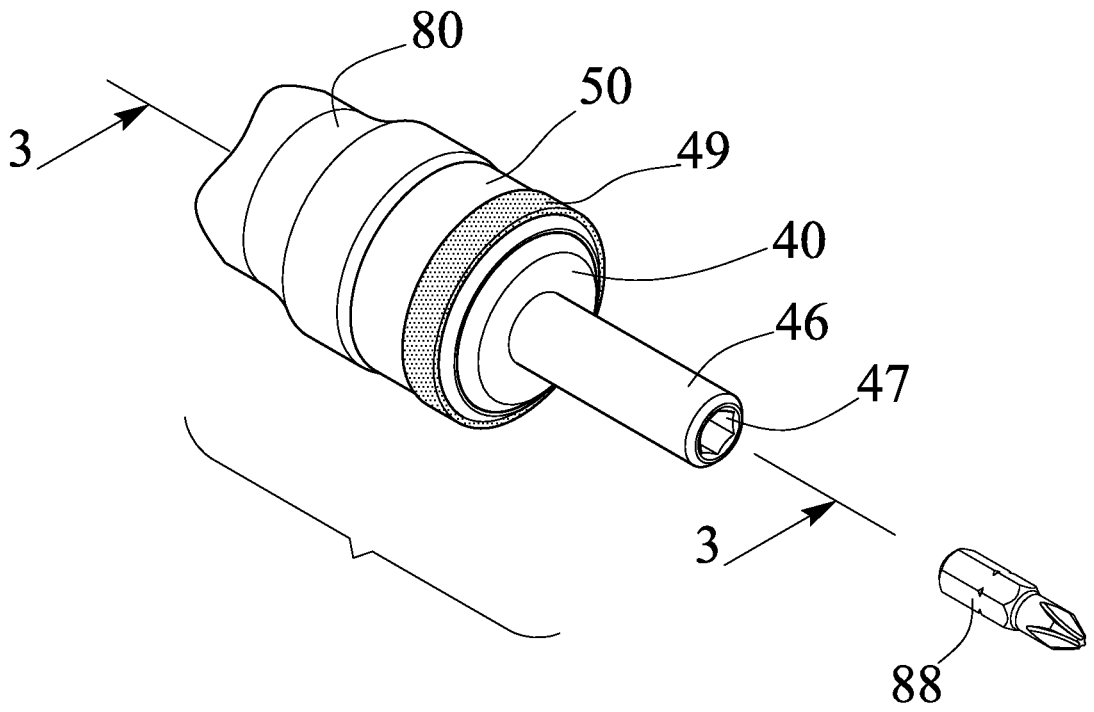
FIG. 1 is a partial exploded view of a ratchet tool device in accordance with the present invention.

Referring to the drawings, and initially to FIGS. 1-5, a ratchet tool device in accordance with the present invention comprises a shank or shaft 10 including an extension or stem 11 extended axially and outwardly therefrom for engaging with and for coupling to a handle 80, the shaft 10 may include one or more keys or projections 12 extended from the stem 11 for engaging with the handle 80 and for solidly and stably securing or coupling the stem 11 to the handle 80 and for allowing the handle 80 and the stem 11 to be pivoted or rotated in concert with each other. The shaft 10 includes two spaces or compartments 13, 14 formed therein and each defined by a recessed or rounded or curved surface 15, 16 (FIGS. 2, 4), and includes two cavities 17, 18 formed therein and communicating with the compartments 13, 14 of the shaft 10 respectively.

The shaft 10 further includes a groove 19 laterally formed therein and faced or directed opposite to or away from the compartments 13, 14 of the shaft 10 for slidably receiving or engaging with a spring biased projection 20 (FIGS. 2, 5), and the shaft 10 further includes a curved depression or channel 21 formed therein (FIG. 5) and formed or defined between two end stops 22, 23, and also faced or directed opposite to or away from the compartments 13, 14 of the shaft 10, and communicating with the groove 19 of the shaft 10.

Two detents or pawls 30, 31 each include a stud or pin 32 extended therefrom for engaging with the cavities 17, 18 of the shaft 10 respectively and for pivotally or rotatably attaching or mounting or securing the pawls 30, 31 to the shaft 10, it is preferable that the pawls 30, 31 each include a rounded or curved surface 33 formed or provided on the outer peripheral portion thereof for contacting or engaging with the corresponding curved surfaces 15, 16 of the shaft 10 respectively (FIG. 4) and for allowing the pawls 30, 31 to be solidly and stably and smoothly pivoted or rotated relative to the shaft 10. The pawls 30, 31 each include a serrated surface or toothed portion or segment 34 formed or provided on the outer peripheral portion thereof and located opposite to or away from the pin 32 and the curved surface 33 of the pawls 30, 31 respectively and faced or directed outwardly.

Figure 2:
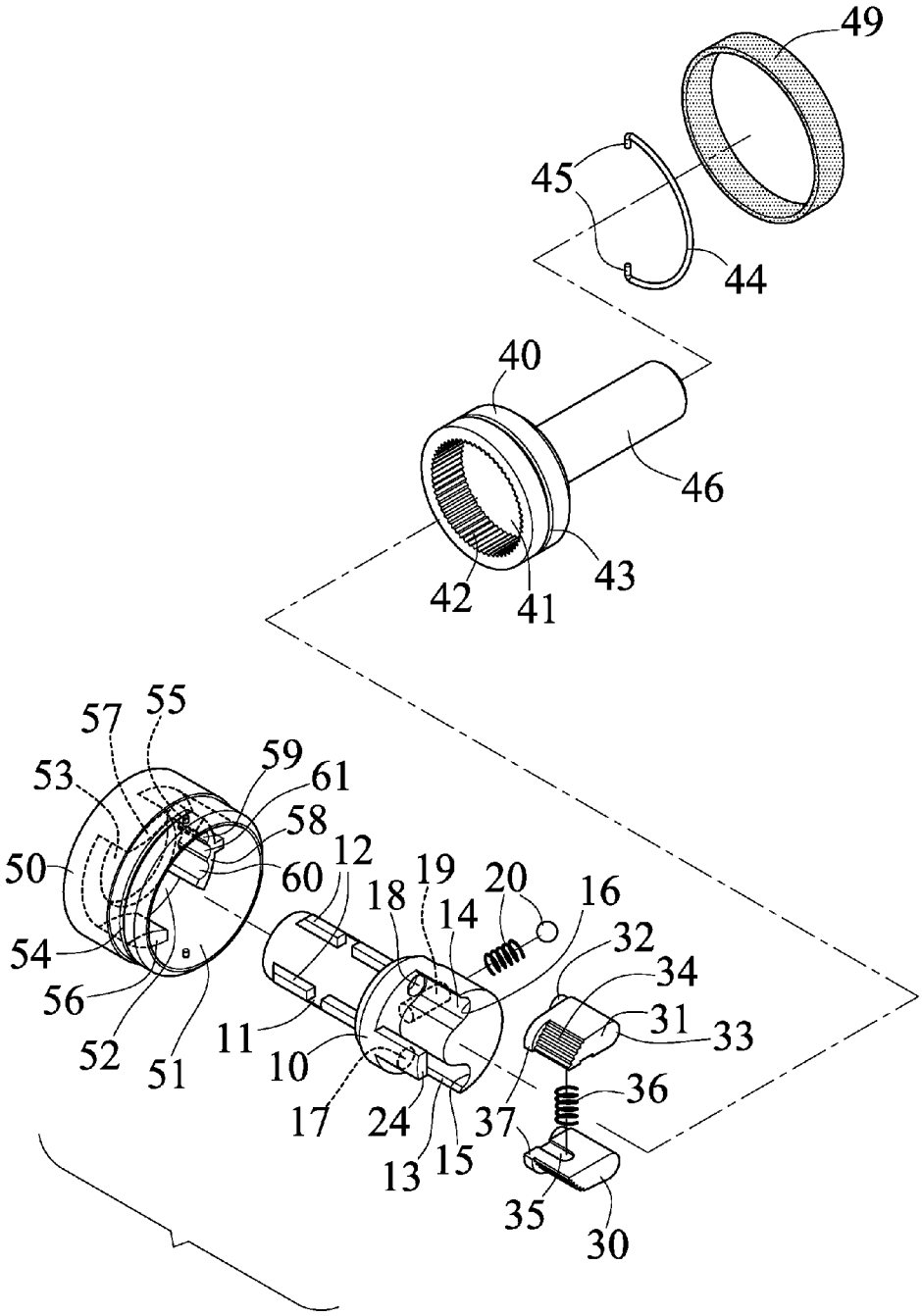
FIG. 2 is another partial exploded view of the ratchet tool device.
Figure 7:
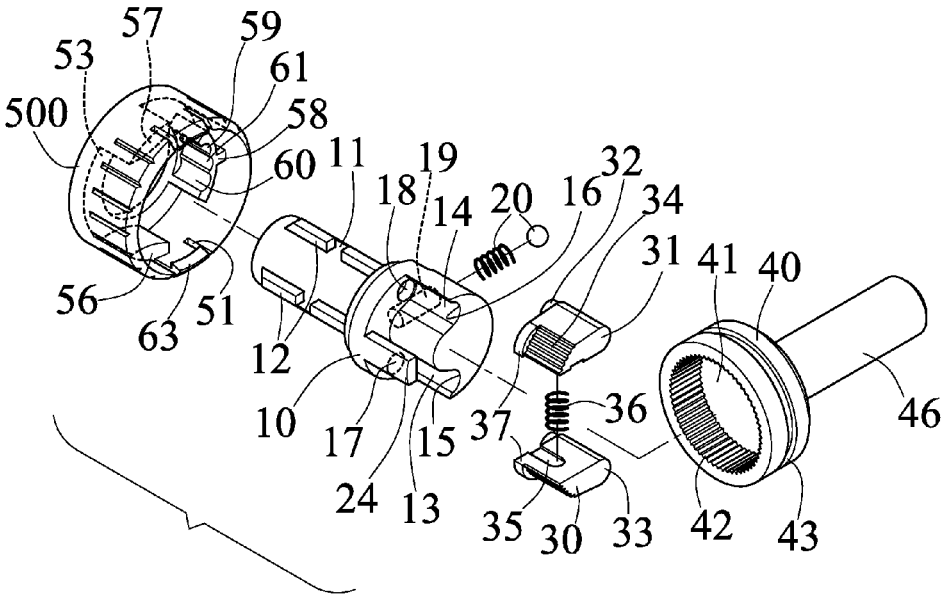
FIG. 7 is a still further partial exploded view of the ratchet tool device as shown in FIG. 6.
Figure 8:
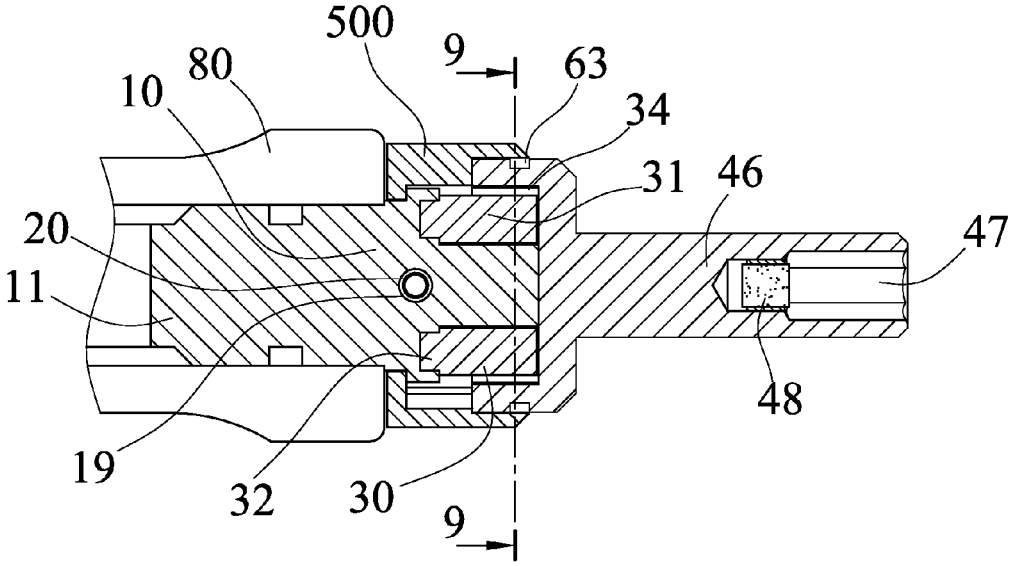
FIG. 8 is a partial cross sectional view of the ratchet tool device, taken along lines 8-8 of FIG. 6.
Figure 9:
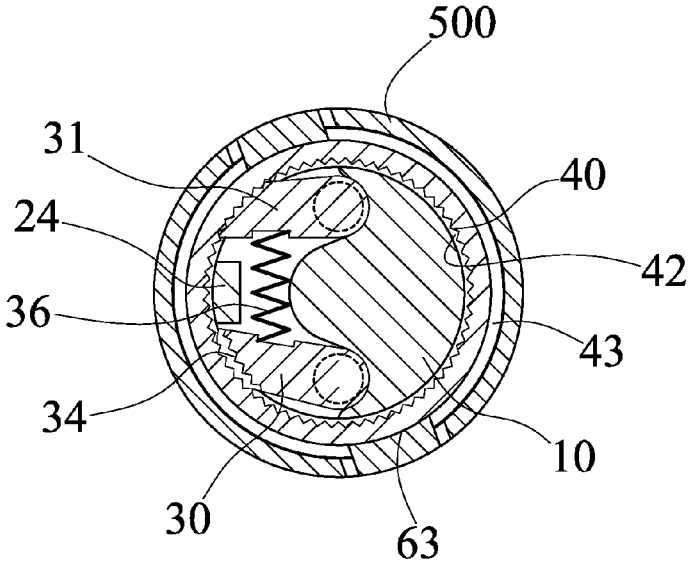
FIG. 9 is a cross sectional view of the ratchet tool device, taken along lines 9-9 of FIG. 8.

The pawls 30, 31 each include a depression or recess 35 formed therein for engaging with a spring biasing member 36 which is disposed or attached or engaged between the pawls 30, 31 for biasing and forcing or moving the pawls 30, 31 away from each other. The shaft 10 may further include a column or pole 24 extended therefrom (FIGS. 4, 7) for engaging with the spring biasing member 36 and for anchoring or retaining or positioning or limiting the spring biasing member 36 within the compartments 13, 14 of the shaft 10 (FIG. 4), and for preventing the spring biasing member 36 from being disengaged or separated from the shaft 10. The pawls 30, 31 each further include a swelling 37 extended therefrom and located beside the toothed segment 34 thereof respectively (FIGS. 2, 3).

A follower or barrel 40 includes a chamber or compartment or opening 41 formed therein for receiving or engaging with the shaft 10, and includes an internal gear 42 formed or provided therein for engaging with the toothed segments 34 of the pawls 30, 31 (FIGS. 3, 4) and for determining the driven or rotational direction of the barrel 40 with or by the shaft 10, and includes a peripheral slot 43 formed in the outer peripheral portion thereof for engaging with a spring biasing or retaining member 44 which includes two folded end members 45, and the barrel 40 further includes a shank 46 extended axially and outwardly therefrom, and further includes a socket opening 47 formed in the outer or free end of the shank 46 for engaging with a tool member 88 or the like. It is preferable that the socket opening 47 includes a non-circular cross section, such as a hexagonal cross section for engaging with and for effectively rotating or driving the tool member 88. The spring biasing member 36 may bias and force and move the toothed segments 34 of the pawls 30, 31 to stably or solidly engage with the internal gear 42 of the barrel 40.

Figure 3:
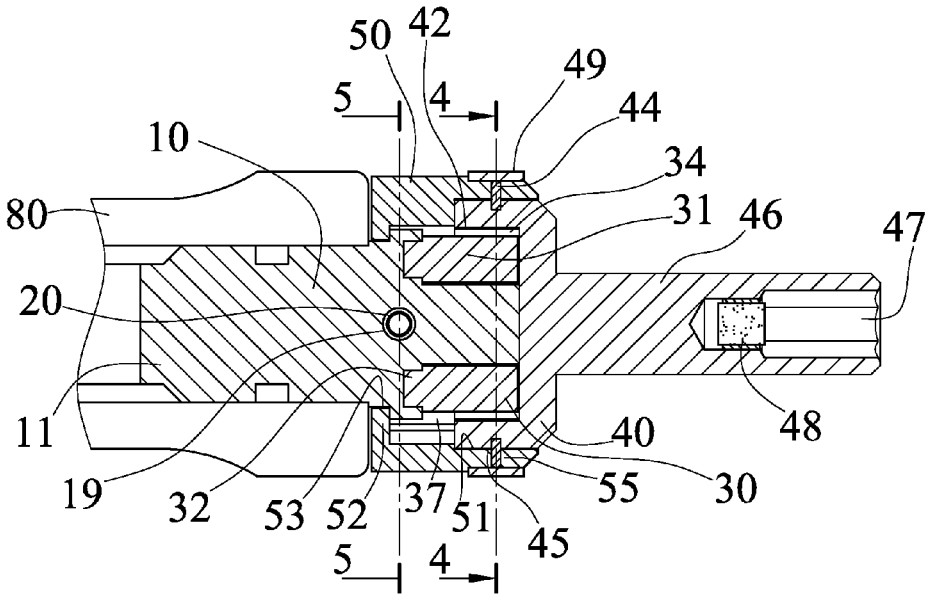
FIG. 3 is a partial cross sectional view of the ratchet tool device, taken along lines 3-3 of FIG. 1.

A sleeve or control ferrule 50 includes a compartment or chamber 51 formed therein for receiving or engaging with the shaft 10 and the barrel 40 (FIG. 3), and includes a peripheral flange 52 extended radially and inwardly therefrom for forming or defining an inner diameter reduced orifice 53 therein (FIGS. 2, 3) and for receiving or engaging with the stem 11, as best shown in FIG. 3, the peripheral flange 52 of the control ferrule 50 is contacted or engaged with the shaft 10 and the handle 80 and rotatably or pivotally anchored or retained between the shaft 10 and the handle 80, the control ferrule 50 includes a peripheral recess 54 formed in the outer peripheral portion thereof for receiving or engaging with the retaining member 44, and includes one or more, such as two cavities 55 formed therein (FIGS. 2, 4) and communicating with the peripheral recess 54 thereof for receiving or engaging with the end members 45 of the retaining member 44.

Figure 4:
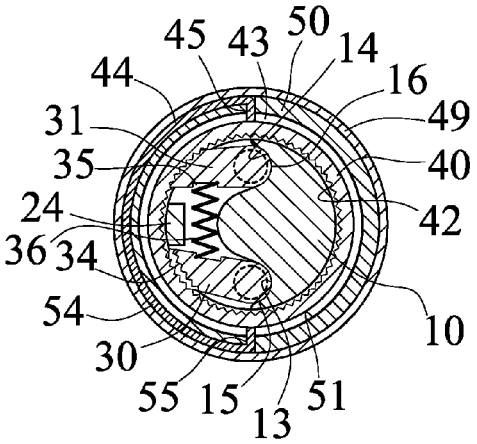
FIGS. 4, 5 are cross sectional views of the ratchet tool device, taken along lines 4-4, 5-5 of FIG. 3 respectively.

As shown in FIGS. 3 and 4, the cavities 55 of the control ferrule 50 are also communicating with the chamber 51 of the control ferrule 50 for allowing the end members 45 of the retaining member 44 to be engaged into the chamber 51 of the control ferrule 50, and slidably engaged in the peripheral slot 43 of the barrel 40 for pivotally or rotatably securing or coupling and retaining the barrel 40 to the control ferrule 50. A sleeve or ring member or collar 49 may further be provided and attached or mounted or engaged onto the control ferrule 50 (FIGS. 1, 4) and engaged with the retaining member 44 (FIGS. 3, 4) for anchoring or retaining or positioning the end members 45 of the retaining member 44 in engagement with the peripheral slot 43 of the barrel 40, and thus for pivotally or rotatably securing or coupling and retaining the barrel 40 to the control ferrule 50 and the shaft 10.

The control ferrule 50 includes two protrusions or swellings or actuators 56, 57 extended into the chamber 51 of the control ferrule 50 (FIGS. 2, 5) for contacting or engaging with the corresponding swellings 37 of the pawls 30, 31 respectively and for selectively disengaging or separating the toothed segments 34 of the pawls 30, 31 from the internal gear 42 of the barrel 40. For example, as shown in FIGS. 4 and 5, when the control ferrule 50 is pivoted or rotated in one or first direction, such as clockwise relative to the shaft 10 for a predetermined angle, such as ten to twenty degrees, only one of the actuators 56 may be contacted or engaged with the swelling 37 (FIG. 5) of one of the pawls 30 for moving and disengaging or separating the toothed segments 34 of the pawl 30 from the internal gear 42 of the barrel 40 (FIG. 4), at this moment, the toothed segments 34 of the other pawl 31 are still engaged with the internal gear 42 of the barrel 40 such that the shank 46 of the barrel 40 may be rotated or driven counterclockwise with or by the shaft 10 by the user, for example.

On the contrary, when the control ferrule 50 is pivoted or rotated in the other or opposite or second direction, such as counterclockwise relative to the shaft 10 for a predetermined angle until the other actuator 57 of the control ferrule 50 is contacted or engaged with the swelling 37 of the other pawl 31, the toothed segments 34 of the other pawl 31 may be moved or disengaged or separated from the internal gear 42 of the barrel 40, at this moment, the toothed segments 34 of the pawl 30 are engaged with the internal gear 42 of the barrel 40 such that the shank 46 of the barrel 40 may be rotated or driven clockwise with or by the shaft 10 by the user, for example.

When the actuators 56, 57 are both engaged with the swellings 37 of the pawls 30, 31, the toothed segments 34 of the other pawl 31 may be arranged to be disengaged or separated from the internal gear 42 of the barrel 40 for allowing the control ferrule 50 to be freely pivoted or rotated relative to the shaft 10 in both directions. Alternatively, the actuators 56, 57 may also be arranged to be disengaged or separated from the swellings 37 of the pawls 30, 31, and the toothed segments 34 of the other pawl 31 may also be arranged to be engaged with the internal gear 42 of the barrel 40 simultaneously.

Figure 5:
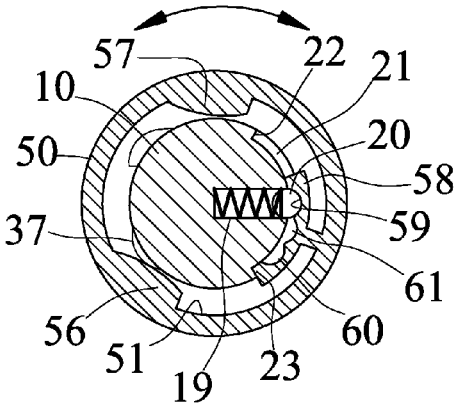
Figure 6:
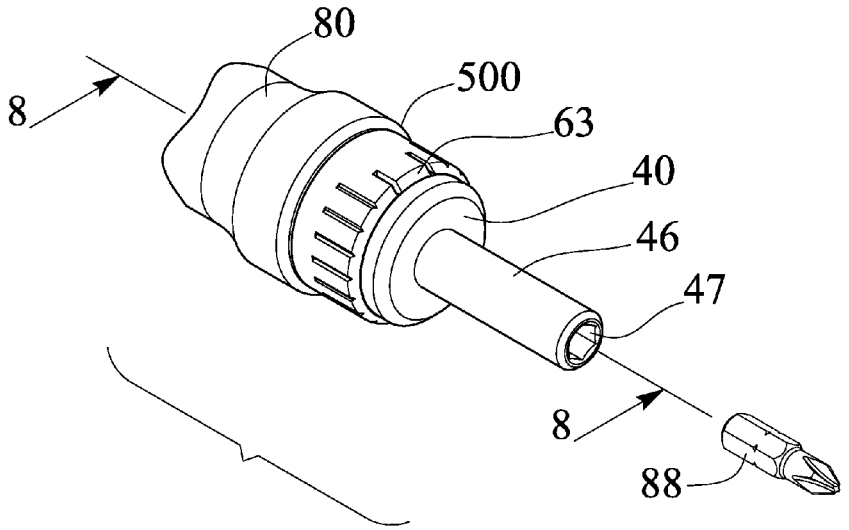
FIG. 6 is a further partial exploded view similar to FIG. 1, illustrating the other arrangement or application of the ratchet tool device.

As shown in FIGS. 2 and 5, the control ferrule 50 further includes a protrusion or seat 58 extended therefrom, and/or formed or provided in the chamber 51 of the control ferrule 50, and includes two or more (such as three) depressions 59, 60, 61 formed therein, such as formed in the seat 58 for selectively engaging with the spring biased projection 20 of the shaft 10 (FIG. 5) and for anchoring or retaining or positioning the control ferrule 50 to the shaft 10 at selected positions or locations. For example, as shown in FIG. 5, when the spring biased projection 20 of the shaft 10 is engaged with the first depression 59 of the seat 58 or of the control ferrule 50, the actuator 56 may be contacted or engaged with the swelling 37 of the pawl 30 and the toothed segments 34 of the pawl 30 may be disengaged or separated from the internal gear 42 of the barrel 40 (FIG. 4).

When the control ferrule 50 is pivoted or rotated counterclockwise relative to the shaft 10 for a predetermined angle until the other actuator 57 of the control ferrule 50 is contacted or engaged with the swelling 37 of the other pawl 31, the spring biased projection 20 of the shaft 10 may be engaged with the other or second depression 60 of the seat 58 or of the control ferrule 50; and the spring biased projection 20 of the shaft 10 may be engaged with the further or middle depression 61 of the seat 58 or of the control ferrule 50 when the actuators 56, 57 are both engaged with the swellings 37 of the pawls 30, 31 or when the actuators 56, 57 are both disengaged or separated from the swellings 37 of the pawls 30, 31. As shown in FIG. 5, the seat 58 is engaged with the curved channel 21 of the shaft 10, and the end stops 22, 23 of the shaft 10 may be engaged with the seat 58 for guiding and limiting the seat 58 and the control ferrule 50 to pivot or rotate relative to the shaft 10 and/or the barrel 40, and/or for anchoring or retaining or positioning the spring biased projection 20 of the shaft 10 in engagement with either of the depressions 59, 60, 61 of the seat 58.

Alternatively, as shown in FIGS. 6-9, without the collar 49 (FIGS. 1-4), the control ferrule 500 may include one or more (such as two) spring biased latches or catches 63 extended radially and inwardly therefrom for engaging with the peripheral slot 43 of the barrel 40, and thus for pivotally or rotatably securing or coupling and retaining the barrel 40 to the control ferrule 500 and for preventing the barrel 40 from being disengaged or separated from the control ferrule 500 and the shaft 10, and also for anchoring or retaining or positioning either or both of the toothed segments 34 of the pawls 30, 31 in engagement with the internal gear 42 of the barrel 40.

Accordingly, the ratchet tool device in accordance with the present invention may be provided for effectively driving tool members, fasteners, work pieces or other driven members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool device comprising:

a shaft including two compartments formed therein and said two compartments each defined by a curved surface, said shaft including two cavities formed therein and communicating with said compartments of said shaft respectively, a first pawl and a second pawl each including a pin extended therefrom and engaged with said cavities of said shaft respectively for pivotally attaching said first and said second pawls to said shaft, said first and said second pawls each including a curved surface for engaging with said curved surface of said shaft respectively and for guiding said first and said second pawls to rotate relative to said shaft, said first and said second pawls each including a toothed segment provided thereon and each including a swelling extended therefrom and located beside said toothed segment respectively, a barrel including an opening formed therein for engaging with said shaft, and including an internal gear provided therein for engaging with said toothed segments of said first and said second pawls and for determining a rotational direction of said barrel by said shaft, said barrel including a shank extended therefrom, a spring biasing member engaged between said first and said second pawls for biasing and forcing said toothed segments of said first and said second pawls to engage with said internal gear of said barrel, a control ferrule including a chamber formed therein for engaging with said shaft and said barrel, and including a first actuator and a second actuator extended into said chamber of said control ferrule for engaging with said swellings of said first and said second pawls respectively and for selectively disengaging said toothed segments of said first and said second pawls from said internal gear of said barrel, and said control ferrule including a first depression and a second depression formed therein, and a spring biased projection disposed in said shaft for selectively engaging with either said first or said second depression of said control ferrule and for anchoring said control ferrule to said shaft at selected positions, and said control ferrule including a retaining member engaged with said control ferrule, and said retaining member including two folded end members engaged with said barrel for rotatably securing said barrel to said control ferrule, said control ferrule including a peripheral recess formed therein for engaging with said retaining member, and including two cavities formed therein and communicating with said peripheral recess of said control ferrule for engaging with said folded end members of said retaining member.

2. The ratchet tool device as claimed in claim 1, wherein said shaft includes a groove formed therein for engaging with said spring biased projection.

3. The ratchet tool device as claimed in claim 1, wherein said first and said second pawls each include a recess formed therein for engaging with said spring biasing member.

4. The ratchet tool device as claimed in claim 1, wherein said shaft includes a stem extended therefrom, and said control ferrule includes a peripheral flange extended radially and inwardly therefrom for forming an orifice therein and for engaging with said stem, said peripheral flange of said control ferrule is engaged with said shaft for anchoring said control ferrule to said shaft.

5. The ratchet tool device as claimed in claim 1 further comprising a handle attached to said stem, and said stem includes at least one projection extended from said stem for engaging with said handle and for allowing said handle and said stem to be rotated in concert with each other.

6. The ratchet tool device as claimed in claim 1, wherein said control ferrule includes a seat, and said first depression and said second depression are formed in said seat.

7. The ratchet tool device as claimed in claim 1, wherein said barrel includes a peripheral slot formed in an outer peripheral portion of said barrel for engaging with said folded end members of said retaining member and for rotatably securing said barrel to said control ferrule.

8. The ratchet tool device as claimed in claim 7, wherein said control ferrule includes a collar engaged onto said control ferrule and engaged with said retaining member for retaining said folded end members of said retaining member in engagement with said peripheral slot of said barrel and for rotatably securing said barrel to said control ferrule and said shaft.

9. The ratchet tool device as claimed in claim 1, wherein said shaft includes a pole for retaining said spring biasing member between said first and said second pawls.

* * * * *